US009051635B2

(12) United States Patent
Jou

(10) Patent No.: US 9,051,635 B2
(45) Date of Patent: Jun. 9, 2015

(54) LOWER-COST, ULTRA-HIGH-STRENGTH, HIGH-TOUGHNESS STEEL

(76) Inventor: Herng-Jeng Jou, Wilmette, IL (US)

( * ) Notice: Subject to any disclaimer, the term of this patent is extended or adjusted under 35 U.S.C. 154(b) by 676 days.

(21) Appl. No.: 12/390,147

(22) Filed: Feb. 20, 2009

(65) Prior Publication Data

US 2010/0230015 A1 Sep. 16, 2010

Related U.S. Application Data

(60) Provisional application No. 61/098,037, filed on Sep. 18, 2008, provisional application No. 61/029,970, filed on Feb. 20, 2008.

(51) Int. Cl.

| | |
|---|---|
| ***C21D 6/00*** | (2006.01) |
| ***C22C 38/44*** | (2006.01) |
| ***C22C 38/52*** | (2006.01) |
| ***C21D 6/02*** | (2006.01) |
| ***C21D 6/04*** | (2006.01) |
| ***C22C 38/46*** | (2006.01) |

(52) U.S. Cl.

CPC ..... *C22C 38/52* (2013.01); *C21D 6/004* (2013.01); *C21D 6/007* (2013.01); *C21D 6/02* (2013.01); *C21D 6/04* (2013.01); *C22C 38/44* (2013.01); *C22C 38/46* (2013.01)

(58) Field of Classification Search

USPC ..... 420/96, 97, 105, 107, 108, 109; 148/328, 335, 622

IPC ..... C21D 6/004,6/007, 6/02, 6/04; C22C 38/44

See application file for complete search history.

(56) References Cited

U.S. PATENT DOCUMENTS

| | | | | |
|---|---|---|---|---|
| 2,147,119 | A * | 2/1939 | Emmons | 420/111 |
| 3,366,471 | A * | 1/1968 | Matas et al. | 420/8 |
| 3,502,462 | A | 3/1970 | Dabkowski et al. | |
| 5,087,415 | A | 2/1992 | Hemphill et al. | |
| 5,268,044 | A | 12/1993 | Hemphill et al. | |
| 5,358,577 | A | 10/1994 | Uehara et al. | |
| 6,176,946 | B1 | 1/2001 | Kuehmann et al. | |
| 7,160,399 | B2 | 1/2007 | Kuehmann et al. | |
| 7,235,212 | B2 | 6/2007 | Kuehmann et al. | |

FOREIGN PATENT DOCUMENTS

| | | |
|---|---|---|
| CN | 102016083 A | 4/2011 |
| EP | 0767251 | 4/1997 |
| FR | 2885141 | 11/2006 |
| JP | 48-09022 | 11/1973 |
| JP | 48-90922 | 11/1973 |

(Continued)

OTHER PUBLICATIONS

International Search Report and Written Opinion from PCT Application No. PCT/US/2009/034720 mailed Dec. 22, 2009.

(Continued)

*Primary Examiner* — Sikyin Ip

(74) *Attorney, Agent, or Firm* — Banner & Witcoff, Ltd.

(57) ABSTRACT

A non-stainless steel alloy includes, in combination by weight, about 0.20% to about 0.33% carbon, about 4.0% to about 8.0% cobalt, about 7.0 to about 11.0% nickel, about 0.8% to about 3.0% chromium, about 0.5% to about 2.5% molybdenum, about 0.5% to about 5.9% tungsten, about 0.05% to about 0.20% vanadium, and up to about 0.02% titanium, the balance essentially iron and incidental elements and impurities.

20 Claims, 5 Drawing Sheets

(56) References Cited

FOREIGN PATENT DOCUMENTS

| | | |
|---|---|---|
| JP | 5087683 | 9/2012 |
| WO | 2009131739 A2 | 10/2009 |

OTHER PUBLICATIONS

English translations of claims for CN 102016083.
English translations of claims for WO 2009/131739.
English translation of claims for JP5087683.
Japanese Office Action of Application No. JP 2010-547803 dated Apr. 17, 2012 (the Translation of Notice of Reasons for Rejection is attached).
Chinese Office Action of Application No. JP 200980114709.1 dated Mar. 27, 2012 (the Translation of Notification of the First Office Action and a Brief Translation of the Objections are attached).

* cited by examiner

LOWER-COST, ULTRA-HIGH-STRENGTH, HIGH-TOUGHNESS STEEL

CROSS REFERENCE TO RELATED APPLICATIONS

This application claims priority to and the benefit of U.S. Provisional Application Ser. No. 61/029,970, filed Feb. 20, 2008, entitled "High Strength and Tough Structural Steel With Secondary Hardening Strengthening Carbides," and U.S. Provisional Application Ser. No. 61/098,037, filed Sep. 18, 2008, entitled "High Strength and Tough Structural Steel With Secondary Hardening Strengthening Carbides," each of which is incorporated herein by reference and made part hereof.

FEDERALLY-SPONSORED RESEARCH AND DEVELOPMENT

Activities relating to the development of the subject matter of this invention were funded at least in part by United States Government, Picatinny Arsenal Contract Number DAAE30-01-9-0800-00, the Naval Air Warfare Center Contract Number N68335-07-C-0302 and the Naval Air Warfare Center AD (LKE) Contract Number N68335-11-C-0369, and thus may be subject to license rights and other rights in the United States.

TECHNICAL FIELD

The invention relates to steel alloys, and more particularly, to steel alloys having ultra-high strength and high toughness with acceptable cost of production.

BACKGROUND

AerMet® 100, disclosed in U.S. Pat. Nos. 5,087,415 and 5,268,044, which are incorporated by reference herein and made part hereof, is a commercial ultra-high-strength, non-stainless steel which does not require case hardening. The nominal composition of AerMet 100 is 13.4 Co, 11.1 Ni, 3.1 Cr, 1.2 Mo, 0.23 C, and balance Fe, in wt %. AerMet 100 shows a suitable combination of high strength and fracture toughness for aircraft parts and ordnance. Additionally, AerMet 100 shows an ambient 0.2% yield stress of 1720 MPa and a Rockwell C-scale hardness of 53.0-54.0, with $K_{Ic}$ of 126 MPa√m. However, the alloying elements Co and Ni are rather costly, increasing the overall steel cost and constraining applications. Thus, there has developed a need for a steel with similar mechanical properties as AerMet 100 at a significantly lower cost.

HY180, disclosed in U.S. Pat. No. 3,502,462, which is incorporated by reference herein and made part hereof, is a commercial high-strength, non-stainless steel which does not require case hardening. The nominal composition of HY180 is 10 Ni, 8 Co, 2 Cr, 1 Mo, 0.13 C, 0.1 Mn, 0.05 Si, and balance Fe, in wt %. While the material cost of HY180 is lower than AerMet 100, due to the lower Co addition, the ambient 0.2% yield stress of HY180 is limited to 1240 MPa.

U.S. Pat. No. 5,358,577, which is incorporated by reference herein and made part hereof, discloses a high strength, high toughness stainless steel with a nominal composition of 12-21 Co, 11-15 Cr, 0.5-3.0 Mo, 0-2.0 Ni, 0-2.0 Si, 0-1.0 Mn, 0.16-0.25 C, at least one element selected from the group consisting of 0.1-0.5 V and 0-0.1 Nb, and balance Fe, in wt %. This alloy shows an ambient Ultimate Tensile Strength (UTS) of 1720 MPa or greater and an ambient 0.2% yield stress of 1190 MPa or greater. However, the ambient 0.2% yield stress of this alloy is limited to about 1450 MPa, and furthermore, the material cost is high due to the high Co addition.

Alloys disclosed in U.S. Pat. Nos. 7,160,399 and 7,235,212, which are incorporated by reference herein and made part hereof, display ultra-high-strength, corrosion-resistant steels which do not require case hardening. The nominal composition of one alloy taught by the patents, branded as Ferrium S53®, is 14.0 Co, 10.0 Cr, 5.5 Ni, 2.0 Mo, 1.0 W, 0.30V, 0.21 C, and balance Fe, in wt %. Ferrium S53® exhibits an ambient UTS of about 1980 MPa and an ambient 0.2% yield stress of about 1560 MPa. The $K_{ic}$ of Ferrium S53® is limited to about 72 MPa√m, and the material cost is high due to the high Co addition.

U.S. Pat. No. 6,176,946, which is incorporated by reference herein and made part hereof, discloses a class of steel alloys comprising a case hardened mixture with a core composition of 15-28 Co, 1.5-9.5 Ni, 0.05-0.25 C, and one or more additives selected from 3.5-9 Cr, less than 2.5 Mo, and less than 0.2 V and the balance Fe, in wt %. The mixture taught by the patent is case hardened in the range of surface hardness greater than a Rockwell C-scale hardness of 60. The class of steel alloys taught by the patent is thus distinct from AerMet 100, in that it requires case hardening and also targets a much higher surface hardness. In addition, the material cost for the class of steel alloys taught by the patent is high due to the high Co addition.

The present alloy provides advantages such as ultra-high strength coupled with lower amounts of certain elements to thereby achieve lower cost. A full discussion of the features and advantages of the present invention is deferred to the following detailed description, which proceeds with reference to the accompanying drawings.

BRIEF SUMMARY

Aspects of the invention relate to a steel alloy that includes, in combination by weight: about 0.20% to about 0.33% carbon, about 4.0% to about 8.0% cobalt, about 7.0 to about 11.0% nickel, about 0.8% to about 3.0% chromium, about 0.5% to about 2.5% molybdenum, about 0.5% to about 5.9% tungsten, about 0.05% to about 0.20% vanadium, and up to about 0.02% titanium, the balance essentially iron and incidental elements and impurities.

According to one aspect, the alloy includes, in combination by weight, about 0.25% to about 0.31% carbon, about 6.8% to about 8.0% cobalt, about 9.3 to about 10.5% nickel, about 0.8% to about 2.6% chromium, about 0.9% to about 2.1% molybdenum, about 0.7% to about 2.0% tungsten, about 0.05% to about 0.12% vanadium, and up to about 0.015% titanium, the balance essentially iron and incidental elements and impurities. In another aspect, the alloy includes, in combination by weight, about 0.29% to about 0.31% carbon, about 6.8% to about 7.2% cobalt, about 9.8 to about 10.2% nickel, about 0.8% to about 2.6% chromium, about 0.9% to about 2.1% molybdenum, about 0.7% to about 1.4% tungsten, about 0.05% to about 0.12% vanadium, and up to about 0.015% titanium, the balance essentially iron and incidental elements and impurities.

According to another aspect, the alloy is strengthened at least in part by $M_2C$ carbide precipitates, where M includes one or more elements selected from the group consisting of: Cr, Mo, W, and V.

According to a further aspect, the alloy has a predominately lath martensite microstructure.

According to a still further aspect, the alloy has an ultimate tensile strength of at least about 1900 MPa, and a $K_{IC}$ fracture toughness of at least about 110 MPa√m.

Additional aspects of the invention relate to a method for processing a steel alloy that includes, in combination by weight, about 0.20% to about 0.33% carbon, about 4.0% to about 8.0% cobalt, about 7.0 to about 11.0% nickel, about 0.8% to about 3.0% chromium, about 0.5% to about 2.5% molybdenum, about 0.5% to about 5.9% tungsten, about 0.05% to about 0.20% vanadium, and up to about 0.02% titanium, the balance essentially iron and incidental elements and impurities. The method includes subjecting the alloy to a solutionizing heat treatment at 950° C. to 1100° C. for 60-90 minutes and then to a tempering heat treatment at 465° C. to 550° C. for 4-32 hours.

According to one aspect, the alloy includes, in combination by weight, about 0.25% to about 0.31% carbon, about 6.8% to about 8.0% cobalt, about 9.3 to about 10.5% nickel, about 0.8% to about 2.6% chromium, about 0.9% to about 2.1% molybdenum, about 0.7% to about 2.0% tungsten, about 0.05% to about 0.12% vanadium, and up to about 0.015% titanium, the balance essentially iron and incidental elements and impurities. In another aspect, the alloy includes, in combination by weight, about 0.29% to about 0.31% carbon, about 6.8% to about 7.2% cobalt, about 9.8 to about 10.2% nickel, about 0.8% to about 2.6% chromium, about 0.9% to about 2.1% molybdenum, about 0.7% to about 1.4% tungsten, about 0.05% to about 0.12% vanadium, and up to about 0.015% titanium, the balance essentially iron and incidental elements and impurities.

According to another aspect, the method includes quenching the alloy after the solutionizing heat treatment, and air cooling the alloy after the tempering heat treatment.

According to a further aspect, the method further includes subjecting the alloy to a cryogenic treatment between the solutionizing heat treatment and the tempering heat treatment.

According to a still further aspect, the alloy has a resultant predominately lath martensite microstructure and includes $M_2C$ carbide precipitates, where M includes one or more elements selected from the group consisting of: Cr, Mo, W, and V.

Other features and advantages of the invention will be apparent from the following specification taken in conjunction with the following drawings.

BRIEF DESCRIPTION OF THE DRAWINGS

In the detailed description which follows, reference will be made to the drawings comprised of the following figures.

DETAILED DESCRIPTION

Figure 1:
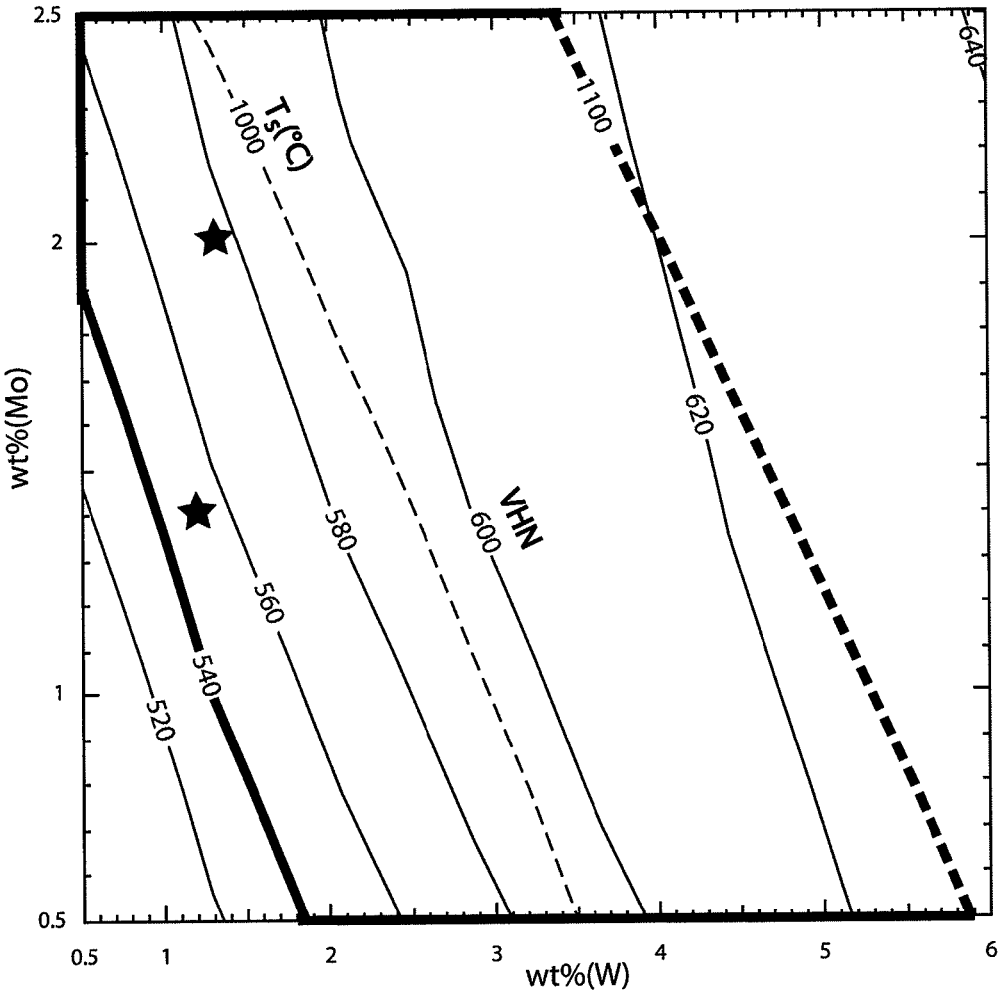
FIG. 1 shows a plurality of composition windows, defined by the calculated Vickers hardness number and solution temperature.

While this invention is susceptible of embodiments in many different forms, exemplary embodiments of the invention are referenced in the drawings and will herein be described in detail with the understanding that the present disclosure is to be considered as an exemplification of the principles of the invention and is not intended to limit the broad aspect of the invention to the embodiments illustrated.

According to embodiments of the present invention, a steel alloy is provided that includes an alloying addition of Co that is lower than that of AerMet 100 and other alloying additions that include W and V. The lower Co content of the invented steel can reduce the thermodynamic driving force of $M_2C$ formation. However, the $M_2C$ formation during tempering assists in obtaining increased strength. The addition of elements such as W and V can assist in achieving a sufficient driving force of $M_2C$ formation to obtain the desired strength. Embodiments of the alloy can be processed so that the alloy comprises a predominantly lath martensitic matrix and is strengthened by a fine-scale distribution of $M_2C$ carbides. In one embodiment, the $M_2C$ carbides measure less than about 20 nm in the longest dimension and comprise the alloying elements of Mo, Cr, W, and V.

FIG. 1 illustrates a composition window of Mo and W according to one embodiment of the alloy, defined by the calculated Vickers hardness number and solution temperature.

In the embodiment described in FIG. 1, the amount of Mo is kept below about 2.5 wt % to avoid microsegregation during solidification of the ingot, and the solution temperature is kept below about 1100° C. to avoid undesirable grain growth. In this embodiment, the addition of W allows for a higher tempering temperature, which can enable the co-precipitation of $M_2C$ and austenite, promoting transformation-induced plasticity and improving toughness. The addition of W can also enable a robust design which tolerates slight variations in tempering and provide the unexpected benefit of enhancing resistance to stress corrosion cracking. In this embodiment, the steel further includes Ti-enriched carbides that can operate to refine the grain size and enhance toughness and strength.

In one example embodiment, an alloy is provided that includes (in wt. %) about 0.20% to about 0.33% carbon (C), about 4.0% to about 8.0% cobalt (Co), about 7.0 to about 11.0% nickel (Ni), about 0.8% to about 3.0% chromium (Cr), about 0.5% to about 2.5% molybdenum (Mo), about 0.5% to about 5.9% tungsten (W), about 0.05% to about 0.20% vanadium (V), and up to about 0.02% titanium (Ti), the balance being essentially iron (Fe) and incidental elements and impurities.

In another embodiment, the alloy includes, in combination by weight, about 0.25% to about 0.31% carbon, about 6.8% to about 8.0% cobalt, about 9.3 to about 10.5% nickel, about 0.8% to about 2.6% chromium, about 0.9% to about 2.1% molybdenum, about 0.7% to about 2.0% tungsten, about 0.05% to about 0.12% vanadium, and up to about 0.015% titanium, the balance essentially iron and incidental elements and impurities.

In yet another embodiment, the alloy comprises, in combination by weight, about 0.29% to about 0.31% carbon, about 6.8% to about 7.2% cobalt, about 9.8 to about 10.2% nickel, about 0.8% to about 2.6% chromium, about 0.9% to about 2.1% molybdenum, about 0.7% to about 1.4% tungsten, about 0.05% to about 0.12% vanadium, and up to about 0.015% titanium, the balance essentially iron and incidental elements and impurities.

As stated above, the alloy is strengthened at least in part by $M_2C$ metal carbides. In various embodiments, the alloy may contain metal carbides where M is one or more elements selected from the group consisting of Mo, Cr, W, and V, and may have amounts of each element (if present) decreasing in the order listed, i.e., Mo in the largest concentration, followed by Cr, W, and/or V. In other embodiments, the alloy may contain different amounts of these elements.

Alloys as described herein can be processed in a variety of different manners. In one embodiment, illustrated in FIG. 2, the alloy is first subjected to a solutionizing heat treatment, then rapidly quenched, followed by a tempering heat treatment and air cooling. In one embodiment, the solutionizing heat treatment can be carried out at temperatures in the range of 950° C. to 1100° C. for 60-90 minutes, and the tempering heat treatment can be carried out at temperatures in the range of 465° C. to 550° C. for 4-32 hours. The Examples below illustrate further embodiments of methods for processing the alloy, including different solutionizing treatments and tempering treatments. A cryogenic treatment may also optionally be employed between the solutionizing heat treatment and the tempering heat treatment, such as by immersing in liquid nitrogen for 1-2 hours and then warming to room temperature.

EXAMPLES

Several example embodiments of alloys according to the invention are described below. Table I lists the measured compositions of each alloy embodiment discussed in the Examples below, along with the nominal composition of commercial steel AerMet 100.

TABLE I

| | Composition in wt %, Fe Balanced | | | | | | | |
|---|---|---|---|---|---|---|---|---|
| Alloys | C | Co | Ni | Cr | Mo | W | V | Ti |
| A | 0.29 | 7.17 | 10.46 | 1.02 | 2.00 | 1.28 | 0.10 | <0.01 |
| B | 0.27 | 6.96 | 9.79 | 0.95 | 1.40 | 1.16 | 0.08 | 0.01 |
| C | 0.28 | 6.74 | 9.60 | 0.76 | 1.34 | 1.04 | 0.07 | 0.01 |
| D | 0.28 | 6.94 | 10.2 | 2.62 | 0.94 | 0.72 | 0.046 | 0.01 |
| AerMet 100 | 0.23 | 13.4 | 11.1 | 3.1 | 1.2 | — | — | — |

Figure 2:
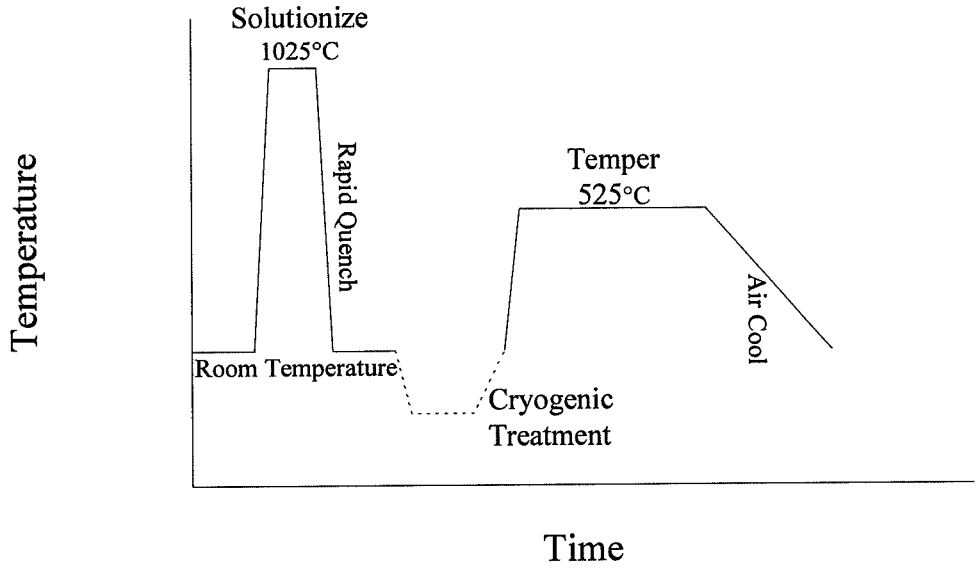
FIG. 2 is a schematic illustration of one embodiment of processing an alloy according to the invention, indicating the time and temperature of processing steps of the method embodiment.

Each of the alloy embodiments in Table I was subjected to processing steps such as those described in FIG. 2, including solutionizing heat treatment and/or tempering heat treatment, as detailed in the Examples described below. Additionally, various tests were performed on the alloys, such as testing one or more physical properties of the alloys, as also detailed in the Examples below.

Example A

A 300-lb vacuum induction melt of alloy A was prepared from high purity materials. The melt was converted to a 3-inch-round-corner-square bar. The alloy was subjected to a solutionizing heat treatment at 1025° C. for 90 minutes, quenched with oil, immersed in liquid nitrogen for 2 hours, warmed in air to room temperature, and then the samples were each subjected to one of several different tempering heat treatments identified in Table II below and cooled in air. The amounts of Ni and C of alloy A served to place the martensite start temperature ($M_s$) above about 200° C., and $M_s$ was confirmed for this alloy as 222° C., using dilatometry. Transmission electron microscopy and atom probe tomography verified the presence of $M_2C$, along with grain refining carbides in specimens tempered at 525° C. for 12 hours or 550° C. for 4 hours. The Charpy V-Notch (CVN) impact energy at −40° C. and tensile strength at room temperature were measured for various tempering conditions, using two samples per each condition. These results are also shown in Table II.

TABLE II

| Tempering | | Ambient 0.1% Yield Stress (MPa) | Charpy V-Notch Energy (ft · lb) at −40° C. |
|---|---|---|---|
| 525° C. | 4 h | 1669 ± 6 | 28.5 ± 1.5 |
| | 6 h | 1683 ± 9 | 28.5 ± 2.5 |
| | 8 h | 1697 ± 3 | 33.5 ± 3.5 |
| | 12 h | 1685 ± 8 | 32.0 ± 0.0 |
| 535° C. | 4 h | 1660 ± 4 | 28.0 ± 1.0 |
| | 6 h | 1626 ± 19 | 21.5 ± 1.5 |
| | 8 h | 1666 ± 10 | 29.5 ± 0.5 |
| 550° C. | 4 h | 1667 ± 6 | 23.0 ± 1.0 |

Figure 3:
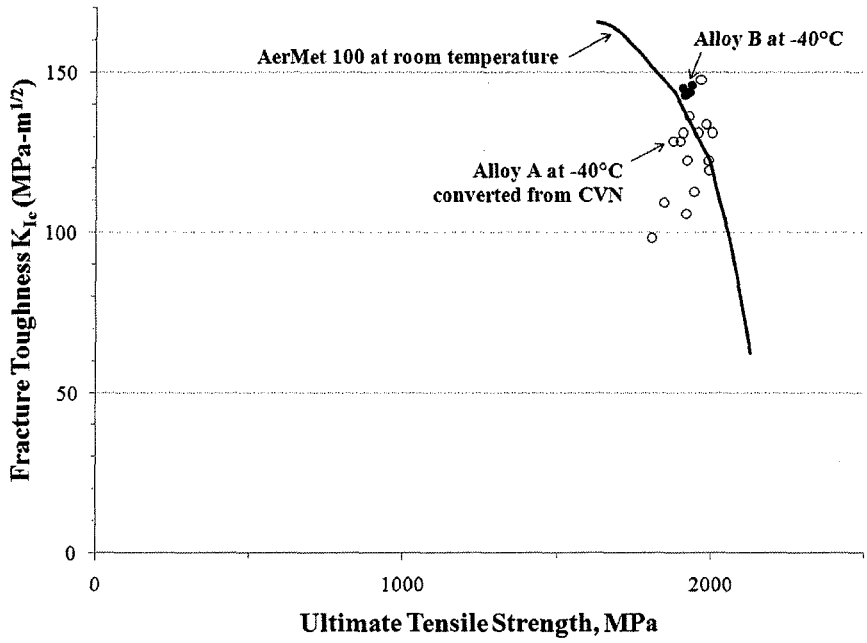
FIG. 3 is a graph illustrating the ultimate tensile strength and $K_{ic}$ fracture toughness of AerMet 100 and two embodiments of alloys (A and B) according to the invention.
Figure 4:
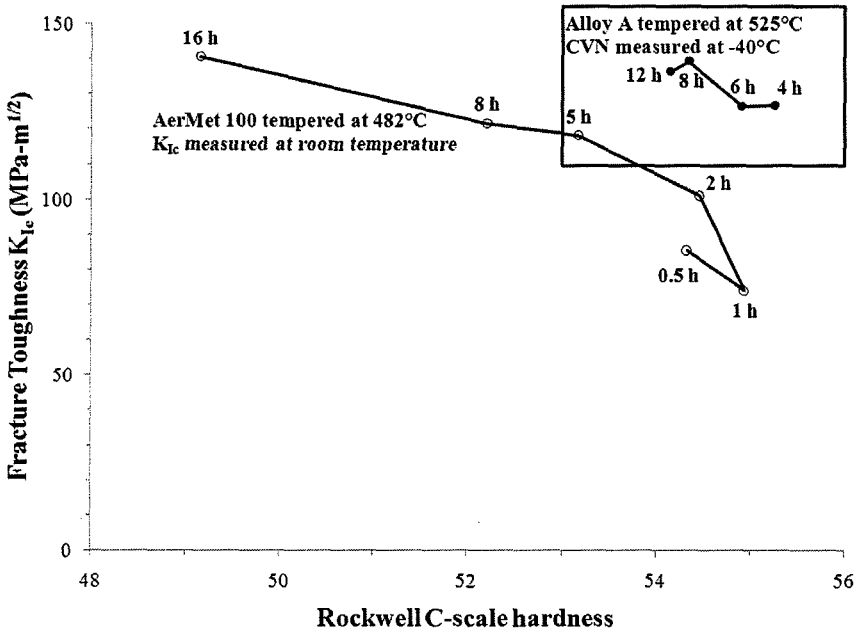
FIG. 4 is a graph illustrating the Rockwell C-scale hardness and $K_{ic}$ fracture toughness of AerMet 100 and one embodiment of an alloy (A) according to the invention, at specified tempering conditions.

The ultimate tensile strength (UTS), $K_{IC}$ fracture toughness, and Rockwell-C hardness were also measured for samples of alloy A. FIG. 3 illustrates a comparison of the UTS and the $K_{IC}$ fracture toughness for the measured samples, and FIG. 4 illustrates a comparison of the Rockwell-C hardness and the $K_{IC}$ fracture toughness for the measured samples. As shown in FIG. 3, alloy A was found to have a comparable and/or superior combination of strength and toughness compared to AerMet 100 in its preferred tempering at 482° C., in particular the samples of alloy A that were tempered at 525° C. Furthermore, alloy A was found to demonstrate a robust design with a built-in tolerance for slight variations in tempering time. The optimum tempering heat treatment in this experiment was found to be 525° C. for 6 hours, although other heat treatments were found to produce positive results. A comparison of the measured properties of alloy A tempered at 525° C. for 6 hours and the properties of AerMet 100 are shown in Table III below.

TABLE III

| | Ambient 0.2% Yield Stress (MPa) | Ambient Ultimate Tensile Stress (MPa) | Elongation (%) | Reduction of Area (%) | Ambient Charpy V-Notch Energy (ft · lb) | Ambient $K_{Ic}$ (MPa√m) |
|---|---|---|---|---|---|---|
| Alloy A | 1800 | 1990 | 14 | 66 | 37 | 122 |
| AerMet 100 | 1720 | 1960 | 14 | 65 | 30 | 126 |

Figure 5:
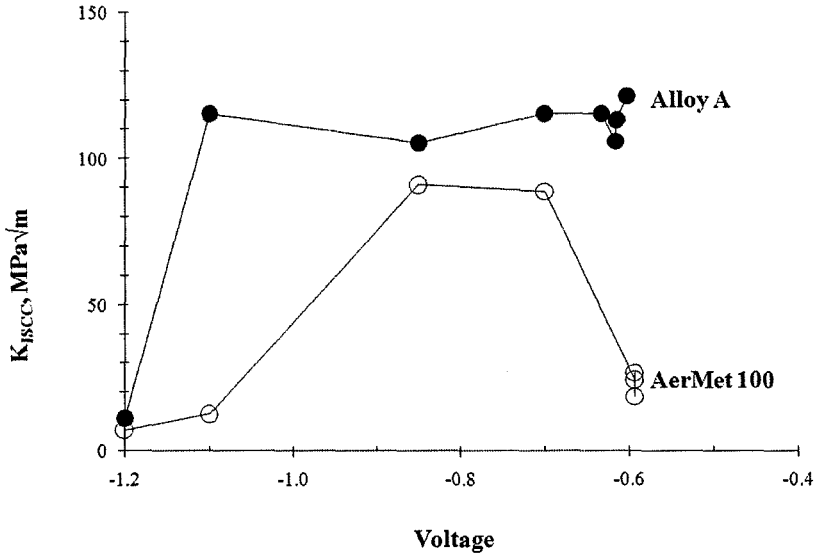
FIG. 5 is a potentiogram comparing the stress-corrosion cracking resistance ($K_{ISCC}$) of one embodiment of an alloy (A) according to the invention and AerMet 100, in solid and open circles, respectively.

Additionally, samples of alloy A were tested for stress corrosion cracking resistance ($K_{ISCC}$) at various applied electrical potentials, using the ASTM F1624/F1940 Standard Test Method for Measurement of Hydrogen Embrittlement in Steel by Incremental Loading Technique. Twelve specimens of alloy A were compared to twelve specimens of AerMet 100, and the results of such testing are shown in FIG. 5. The measured $K_{ISCC}$, or the fracture toughness in stress corrosion cracking, of alloy A was found to be far superior to that of AerMet 100, at Open-Circuit Potential (OCP) (about −0.6V for these steels). As shown in FIG. 5, whereas AerMet 100 maintained only about 20% of its fracture toughness in moving from ambient to OCP, alloy A maintained about 90% of its fracture toughness at OCP. For comparison, Ferrium 553® has been found to maintain about 77% of its fracture toughness at OCP. The improvement in stress cracking corrosion resistance of Alloy A was unexpected.

Example B

A 300-lb vacuum induction melt of alloy B was prepared from high purity materials. The melt was converted to a 3-inch-round-corner-square bar. The alloy was subjected to a solutionizing heat treatment at 1025° C. for 90 minutes, quenched with oil, immersed in liquid nitrogen for 2 hours, and warmed in air to room temperature, and then the samples were each subjected to one of several different tempering heat treatments identified in Table IV below and cooled in air. The amounts of Ni and C of alloy B served to place $M_s$ above about 200° C., and $M_s$ was confirmed for this alloy as 286° C. using dilatometry. The CVN impact energy at −40° C. and tensile strength at room temperature were measured for various tempering conditions, using two samples per each condition. These results are also listed in Table IV.

TABLE IV

| Tempering | | Ambient 0.1% Yield Stress (MPa) | Charpy V-Notch Energy (ft · lb) at −40° C. |
|---|---|---|---|
| 510° C. | 12 h | 1566 ± 4 | 34.5 ± 2.1 |
| | 16 h | 1579 ± 3 | 33.0 ± 2.8 |
| 525° C. | 8 h | 1553 ± 17 | 36.5 ± 0.7 |

The ultimate tensile strength (UTS) and $K_{IC}$ fracture toughness were also measured for samples of alloy B, as indicated in FIG. 3. Alloy B was found to have mechanical characteristics equal to or better than those of AerMet 100, and the optimum tempering heat treatment in this experiment was found to be 525° C. for 8 hours, although other heat treatments were found to produce positive results.

Example C

A 300-lb vacuum induction melt of alloy C was prepared from high purity materials. The melt was converted to a 3-inch-round-corner-square bar. The alloy was subjected to a solutionizing heat treatment at 1025° C. for 90 minutes, quenched with oil, immersed in liquid nitrogen for 2 hours, and warmed in air to room temperature, and then the samples were each subjected to one of several different tempering heat treatments identified in Table V below, and cooled in air. The amounts of Ni and C of alloy C served to place $M_s$ above about 200° C., and $M_s$ was confirmed for this alloy as 247° C. using dilatometry. The CVN impact energy at −40° C. and tensile strength at room temperature were measured for various tempering conditions, using two samples per each condition. These results are also listed in Table V.

TABLE V

| Tempering | | Ambient 0.1% Yield Stress (MPa) | Charpy V-Notch Energy (ft · lb) at −40° C. |
|---|---|---|---|
| 510° C. | 12 h | 1546 ± 11 | 27.5 ± 0.7 |
| | 16 h | 1561 ± 6 | 30.0 ± 0.0 |
| 525° C. | 8 h | 1552 ± 7 | 29.5 ± 2.1 |

Alloy C was found to have mechanical characteristics comparable to those of AerMet 100, and the optimum tempering heat treatment in this experiment was found to be 510° C. for 16 hours, although other heat treatments were found to produce positive results.

Example D

A 300-lb vacuum induction melt of alloy A was prepared from high purity materials. The melt was converted to a 3-inch-round-corner-square bar. The alloy was subjected to a solutionizing heat treatment at 950° C. for 60 minutes, quenched with oil, immersed in liquid nitrogen for 1 hour, and warmed in air to room temperature, and then subjected to a tempering heat treatment at 468° C. for 32 hours or at 482° C. for 16 hours and cooled in air. The CVN impact energy at −40° C., fracture toughness $K_{Ic}$ at room temperature, and tensile strength at room temperature were measured for various tempering conditions. The results of this testing are listed in Table VI below.

TABLE VI

| Tempering | | Ambient 0.2% Yield Stress (MPa) | Charpy V-Notch Energy (ft · lb) at −40° C. | Ambient $K_{Ic}$ (MPa√m) |
|---|---|---|---|---|
| 468° C. | 32 h | 1650 ± 0 | 33.5 ± 2.1 | 138 |
| 482° C. | 16 h | 1628 ± 5 | 36.0 ± 0.0 | 144 |

Alloy D was found to have mechanical characteristics comparable to those of AerMet 100, and neither of the tempering heat treatments in this experiment were found to be comparatively optimum, as both heat treatments were found to produce positive results.

The various embodiments of alloys described herein, processed in the manners described herein, were found to have a comparable or even superior physical properties compared to existing alloys, such as AerMet 100. In particular, the alloy was found to be capable of providing a desirable combination of high tensile strength and high fracture toughness, a robust design which tolerates slight variations in tempering conditions, and the unexpected benefit of enhanced stress corrosion cracking resistance. Additionally, the comparatively smaller alloying additions of Co and Ni reduce the cost of the alloy as compared to existing alloys, such as AerMet 100. It is understood that further benefits and advantages are readily recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying claims.

What is claimed is:

1. A non-stainless steel alloy comprising, in combination by weight:

about 0.20% to about 0.33% carbon, about 4.0% to about 8.0% cobalt, about 7.0% to about 11.0% nickel, about 0.8% to about 3.0% chromium, about 0.5% to about 2.5% molybdenum, about 0.5% to about 5.9% tungsten, about 0.05% to about 0.20% vanadium, and titanium up to about 0.02%, the balance essentially iron and incidental elements and impurities said alloy having a microstructure characterized by MC grain refinement particles by inclusion of principally $M_2C$ carbide particle precipitates wherein $M_2$ is comprised of chromium (Cr), molybdenum (Mo), tungsten (W), and vanadium (V) in a predominately lath martensite matrix, said alloy further characterized by the combination of an ultimate tensile strength of at least about 1900 MPa, a $K_{IC}$, high fracture toughness of at least about 100 to 140 MPa√m and enhanced stress $K_{ISCC}$ corrosion cracking resistance as measured by ASTMF1624 or similar method of at least about 105 to 120 MPa√m.

2. The alloy of claim 1, wherein the alloy comprises, in combination by weight: about 0.25% to about 0.31% carbon, about 6.8% to about 8.0% cobalt, about 9.3 to about 10.5% nickel, about 0.8% to about 2.6% chromium, about 0.9% to about 2.1% molybdenum, about 0.7% to about 2.0% tungsten, about 0.05% to about 0.12% vanadium, and up to about 0.015% titanium, the balance essentially iron and incidental elements and impurities.

3. The alloy of claim 1, wherein the alloy comprises, in combination by weight: about 0.29% to about 0.31% carbon, about 6.8% to about 7.2% cobalt, about 9.8 to about 10.2% nickel, about 0.8% to about 2.6% chromium, about 0.9% to about 2.1% molybdenum, about 0.7% to about 1.4% tungsten, about 0.05% to about 0.12% vanadium, and up to about 0.015% titanium, the balance essentially iron and incidental elements and impurities.

4. The alloy of claim 1, wherein the alloy is strengthened at least in part by $M_2C$ carbide precipitates which measure less than about 20 nm in the longest dimension.

5. The alloy of claim 1, wherein the alloy comprises, in combination by weight: about 0.25% to about 0.31% carbon, about 6.8% to about 8.0% cobalt, about 9.3 to about 10.5% nickel, about 0.8% to about 2.6% chromium, about 0.9% to about 2.1% molybdenum, about 0.7% to about 2.0% tungsten, about 0.05% to about 0.12% vanadium, and titanium up to about 0.015%, the balance essentially iron and incidental elements and impurities.

6. The alloy of claim 1, wherein the alloy comprises, in combination by weight: about 0.29% to about 0.31% carbon, about 6.8% to about 7.2% cobalt, about 9.8 to about 10.2% nickel, about 0.8% to about 2.6% chromium, about 0.9% to about 2.1% molybdenum, about 0.7% to about 1.4% tungsten, about 0.05% to about 0.12% vanadium, and titanium up to about 0.015%, the balance essentially iron and incidental elements and impurities.

7. The alloy of claim 1, wherein the alloy comprises, in combination by weight: about 0.25% to about 0.33% carbon, about 6.0% to about 8.0% cobalt, about 9.0% to about 10.5% nickel, about 0.5% to about 1.5% chromium, about 1.7% to about 2.3% molybdenum, about 0.8% to about 1.8% tungsten, about 0.05% to about 0.15% vanadium, and titanium up to about 0.015%, the balance essentially iron and incidental elements and impurities.

8. The alloy of claim 1, wherein the alloy comprises, in combination by weight: about 0.29% to about 0.31% carbon, about 6.8% to about 7.2% cobalt, about 9.9% to about 10.3% nickel, about 0.8% to about 1.2% chromium, about 1.9% to about 2.1% molybdenum, about 1.2% to about 1.4% tungsten, about 0.05% to about 0.08% vanadium, and titanium up to about 0.015%, the balance essentially iron and incidental elements and impurities.

9. The alloy of claim 1 wherein the collective weight percent of molybdenum (Mo), chromium (Cr), tungsten (W) and vanadium (V) is about 3 to 5 percent.

10. The alloy of claim 1 wherein the collective weight percent of molybdenum (Mo), chromium (Cr), tungsten (W) and vanadium (V) is about 3.2 to 4.4 weight percent.

11. The alloy of claim 1 wherein the alloy is characterized by an ultimate tensile strength of at least about 1900 MPa and a $K_{IC}$ fracture toughness of at least about 110 MPa √m.

12. A method for manufacture of the alloy of claim 1 comprising:

providing a steel alloy comprising, in combination by weight, about 0.20% to about 0.33% carbon, about 4.0% to about 8.0% cobalt, about 7.0 to about 11.0% nickel, about 0.8% to about 3.0% chromium, about 0.5% to about 2.5% molybdenum, about 0.5% to about 5.9% tungsten, about 0.05% to about 0.20% vanadium, and up to about 0.02% titanium, the balance essentially iron and incidental elements and impurities;

subjecting the alloy to a solutionizing heat treatment at 950° C. to 1100° C. for 60-90 minutes; and subjecting the alloy to a tempering heat treatment at 465° C. to 550° C. for 4-32 hours.

13. The method of claim 12, wherein the alloy comprises, in combination by weight, about 0.25% to about 0.31% carbon, about 6.8% to about 8.0% cobalt, about 9.3 to about 10.5% nickel, about 0.8% to about 2.6% chromium, about 0.9% to about 2.1% molybdenum, about 0.7% to about 2.0% tungsten, about 0.05% to about 0.12% vanadium, and up to about 0.015% titanium, the balance essentially iron and incidental elements and impurities.

14. The method of claim 12, wherein the alloy comprises, in combination by weight, about 0.29% to about 0.31% carbon, about 6.8% to about 7.2% cobalt, about 9.8 to about 10.2% nickel, about 0.8% to about 2.6% chromium, about 0.9% to about 2.1% molybdenum, about 0.7% to about 1.4% tungsten, about 0.05% to about 0.12% vanadium, and up to about 0.015% titanium, the balance essentially iron and incidental elements and impurities.

15. The method of claim 12, further comprising:

quenching the alloy after the solutionizing heat treatment; and air cooling the alloy after the tempering heat treatment.

16. The method of claim 9, further comprising:

subjecting the alloy to a cryogenic treatment between the solutionizing heat treatment and the tempering heat treatment.

17. The method of claim 12, wherein the alloy has a resultant microstructure comprising $M_2C$ carbide precipitates which measure less than about 20 nm in the longest dimension.

18. The method of claim 17, wherein the M of the $M_2C$ carbide precipitates comprises one or more elements selected from the group consisting of: Mo, Cr, W, and V.

19. The method of claim 12, wherein the alloy comprises, in combination by weight, about 0.25% to about 0.33% carbon, about 6.0% to about 8.0% cobalt, about 9.0% to about 10.5% nickel, about 0.5% to about 1.5% chromium, about 1.7% to about 2.3% molybdenum, about 0.8% to about 1.8% tungsten, about 0.05% to about 0.15% vanadium, and up to about 0.015% titanium, the balance essentially iron and incidental elements and impurities.

20. The method of claim 12, wherein the alloy comprises, in combination by weight, about 0.29% to about 0.31% carbon, about 6.8% to about 7.2% cobalt, about 9.9% to about 10.3% nickel, about 0.8% to about 1.2% chromium, about 1.9% to about 2.1% molybdenum, about 1.2% to about 1.4% tungsten, about 0.05% to about 0.08% vanadium, and up to about 0.015% titanium, the balance essentially iron and incidental elements and impurities.

* * * * *